US005603294A

United States Patent [19]

Kawai

[11] Patent Number: 5,603,294

[45] Date of Patent: Feb. 18, 1997

[54] VARIABLE VALVE LIFT DEVICE

[75] Inventor: Yoshiyuki Kawai, Nagoya, Japan

[73] Assignee: Aisin Seiki Kabushiki Kaisha, Aichi-pref., Japan

[21] Appl. No.: 576,037

[22] Filed: Dec. 21, 1995

[30] Foreign Application Priority Data

Dec. 28, 1994 [JP] Japan ..... 6-339198

[51] Int. Cl.[6] ..... F01L 13/00

[52] U.S. Cl. ..... 123/90.16; 123/90.48

[58] Field of Search ..... 123/90.15, 90.16, 123/90.17, 90.48, 198 F

[56] References Cited

U.S. PATENT DOCUMENTS

| | | | |
|---|---|---|---|
| 5,090,364 | 2/1992 | McCarroll et al. | 123/90.16 |
| 5,253,621 | 10/1993 | Dopson et al. | 123/90.16 |
| 5,343,833 | 9/1994 | Shirai | 123/90.16 |
| 5,431,133 | 7/1995 | Spath et al. | 123/90.16 |
| 5,488,934 | 2/1996 | Shirai et al. | 123/90.16 |

FOREIGN PATENT DOCUMENTS

| | | |
|---|---|---|
| 6-17630 | 1/1994 | Japan . |
| 7-71213A | 3/1995 | Japan . |
| 7-109910 | 4/1995 | Japan . |

*Primary Examiner*—Weilun Lo
*Attorney, Agent, or Firm*—Hazel & Thomas

[57] ABSTRACT

A variable valve lift device includes an outer cam; an inner cam having a base circle and a nose smaller than the base circle and the nose of the outer cam; at least one of an intake and exhaust valve opened and closed by being moved in the axial direction thereof, the valve being biased in the closing direction; an outer lifter biased in a direction which brings it into contact with the outer cam, the outer lifter being provided in an engine head; an inner lifter in abutting contact with an upper end face of the valve and having a groove in an outer periphery thereof; a plate slidable in a direction which perpendicularly intersects the axis of the valve, the plate moving together with the outer lifter; and control means for moving the plate in the direction which perpendicularly intersects the axis of the valve. The control means is capable of selecting a high-lift mode in which the plate is moved to a position at which it engages with the groove to thereby open/close the valve in a state of high lift, and a low-lift mode in which the plate is moved to a position at which it does not engage with the groove to thereby open/close the valve in a state of low lift.

3 Claims, 4 Drawing Sheets

VARIABLE VALVE LIFT DEVICE

BACKGROUND OF THE INVENTION

1. Field of the Invention

This invention relates to a variable valve lift device for varying the opening and closing timing or amount of lift of intake and exhaust valves in order to regulate the amount of suction and exhaust at low and high rotational speed of an engine.

2. Discussion of the Related Art

In the engine of an automobile or the like, the amount of suction and exhaust required is small immediately after the engine is started and when the engine is running at low rpm or under a small load. The amount of suction and exhaust required increases when the engine is running at high rpm or under a high load. It has therefore been contemplated to obtain appropriate engine output and reduce the amount of fuel consumption by controlling the opening and closing amount of the intake and exhaust valves as well as the operation timing of the valves.

A variable valve lift device for achieving this is described in the specification of Japanese Patent KOKAI Publication No. 6(1994)-17630 entitled "Variable Valve Timing and Lift Mechanism". In the disclosed variable valve lift device, first through third cylinder holes are arranged in a direction which perpendicularly intersects the axial direction of outer and inner lifters. The first through third cylinder holes are so arranged as to connect coaxially when respective ones of the outer and inner lifters come into contact with the base circles of respective ones of a high-speed cam (outer cam) and a low-speed cam (inner cam) so that the top surfaces of the outer and inner lifters lie in the same plane. In addition, a rotation preventing mechanism for preventing relative rotation between the outer and inner lifters is so arranged that the first through third cylinder holes will lie on the same axis. First through third pins are slidably fitted into respective ones of the coaxially connected cylinder holes, and a spring which urges the third pin toward the side of the second pin at all times and a stopper are disposed within the third pin. A changeover valve reduces hydraulic pressure to the first cylinder hole when the engine is running at low rpm and increases hydraulic pressure to the first cylinder hole at high rpm.

However, according to the inventor's investigation it has turned out that a problem arises in the above-described arrangement in which the top surfaces of the upper and lower lifters reside in the same plane when the upper and lower lifters are in abutting contact with the base circles of the outer and inner cams, respectively. Specifically, at low rpm, namely when the first through third pins make it possible for the outer lifter and inner lifter to move up and down relative to each other, the inner cam contacts the peripheral portion of the top surface of the rising inner lifter, thereby causing wear or deformation of the cam or lifter.

Further, in order to fit the cylindrically shaped first through third pins, the outer and inner lifters must each be increased in thickness in the axial direction to provide sufficient strength. In addition, the cylindrically shaped pins have a pin diameter that is greater than the thickness of a plate because of strength considerations, and the result in a device having a large overall bulk.

Further, the outer periphery of the outer lifter is provided with holes for receiving the fitted pins. Owing to constant sliding within a guide hole, this causes fatigue fracture at this portion of the outer lifter.

Furthermore, since relative rotation between the outer and inner lifters is prevented by the rotation preventing mechanism, the inner and outer cams, for which the driving forces are different, sustain wear at the surfaces of contact between the lifters. In addition, a force which attempts to rotate the outer and inner lifters is produced and causes deformation of the pins or rotation preventing mechanism.

SUMMARY OF THE DISCLOSURE

Accordingly, an object of the present invention is to provide a variable valve lift device so adapted as to suppress wear, deformation and fatigue fracture of the members constructing the device, thereby furnishing the device with durability and a long service life.

In order to achieve this objective, a variable valve lift device is provided with the inner cam whose base circle and nose are smaller than that of the outer cam. A groove is formed in an outer periphery of the inner lifter. A plate is disposed so as to move together with the outer lifter and so as to be slidable in a direction which perpendicularly intersects the axis of the valve. A control means moves the plate in the direction which perpendicularly intersects the axis of the valve and selects one of a high-lift mode in which the plate is moved to the first position at which it engages with the groove to open or close the valve in a state of high lift and a low-lift mode in which the plate is moved to the second position at which it does not engage with the groove to open or close the valve in a state a low lift.

The above variable valve lift device may be further provided with the plate which has a through-hole whose size is substantially the same as the outer diameter of the inner lifter and a thickness which can be engaged in the groove of the plate. An urging means biases the plate toward one of the first position at which an axial center of the groove and an axial center of the through-hole coincide and the second position at which the axial center of the groove and the axial center of the through-hole do not coincide. A hydraulic mechanism biases the plate toward the other one of the first position and the second position. The control means controls the hydraulic mechanism so that the plate is moved toward the first position or the second position.

PREFERRED EMBODIMENTS

According to a first aspect of the preferred embodiments of the present invention, there is provided a variable valve lift device comprising an outer cam having a base circle and a nose; an inner cam having a base circle and a nose smaller than the base circle and the nose of the outer cam; at least one of intake and exhaust valve (may be termed as "intake/exhaust valve") opened and closed by being moved in the axial direction thereof, the valve being biased in the closing direction; an outer lifter biased in a direction which brings it into contact with the outer cam, the outer lifter being provided in an engine head; an inner lifter in abutting contact with an upper end face of the valve and having a groove in an outer periphery thereof; a plate slidable in a direction which perpendicularly intersects the axis of the valve, the plate moving together with the outer lifter; and control means for moving the plate in the direction which perpendicularly intersects the axis of the valve; the control means being capable of selecting a high-lift mode in which the plate is moved to a position at which it engages with the groove to thereby open/close the valve in a state of high lift, and a low-lift mode in which the plate is moved to a position at which it does not engage with the groove to thereby open/close the valve in a state of low lift.

In a second aspect, there is provided a variable valve lift device comprising an outer cam having a base circle and a nose; an inner cam having a base circle and a nose smaller than the base circle and the nose of the outer cam; at least one of an intake and exhaust valve opened and closed by being moved in the axial direction thereof; an inner lifter having a lower end face in abutting contact with an upper end face of the valve and having a groove in an outer periphery thereof; an outer lifter having an upper end wall into which the inner lifter is fitted so as to be slidable in the axial direction of the valve, and a cylindrically shaped side wall slidably fitted into a guide bore provided in a cylinder head of an engine; a plate slidable in a direction which perpendicularly intersects the axis of the valve, the plate being provided in the outer lifter and having a through-hole of a size substantially the same as the outer diameter of the inner lifter and a thickness for engaging with the groove, the inner lifter being slidable in the through-hole; a first spring for biasing the valve in a direction which brings it into contact with a lifting face of the inner cam; a second spring for biasing the outer lifter and the plate in a direction which bring them into contact with a lifting face of the outer cam; a third spring for biasing the plate toward one of a first position at which an axial center of the groove and an axial center of the through-hole coincide and a second position at which an axial center of said groove and an axial center of said through-hole do not coincide; a hydraulic mechanism for biasing the plate toward the other one of said first and second positions at which an axial center of the groove and an axial center of the through-hole do not coincide; and control means for controlling the hydraulic mechanism to thereby move the plate toward said first or second position.

In the second aspect, the third spring may bias the plate at the second position at which the axial center of the groove and the axial center of the through-hole do not coincide, and the hydraulic mechanism may bias the plate at the first position at which the axial center of the groove and the axial center of the through-hole coincide.

Also in the second aspect, the hydraulic mechanism may supply hydraulic pressure via a passageway penetrating the side wall of the outer lifter and formed at a portion thereof at which the plate is fitted into the outer lifter, and an annular groove formed in an outer peripheral portion of the side wall of the outer lifter, the outer peripheral portion including the passageway.

In operation, the first aspect is such that when the control means moves the plate to the position at which it engages with the groove, the amount of lift of the outer lifter is transmitted to the valve, whereby the valve can be made to open/close in a state (mode) of high lift. When the control means moves the plate to the position at which it does not engage with the groove, the amount of lift of the inner lifter is transmitted to the valve, whereby the valve can be made to open/close in a state (mode) of low lift.

In accordance with the second aspect, when the control means controls the hydraulic mechanism to move the plate to the first position at which the axial center of the groove and the axial center of the through-hole coincide, the inner lifter and outer lifter are capable of moving relative to each other and the amount of lift of the inner lifter is transmitted to the valve so that the valve can be opened/closed in the state of low lift. When the control means controls the hydraulic mechanism to move the plate to the second position at which the axial center of the groove and the axial center of the through-hole do not coincide, the inner lifter and outer lifter are not capable of moving relative to each other and the amount of lift of the outer lifter is transmitted to the valve so that the valve can be opened/closed in the state of high lift.

The third aspect is such that if hydraulic pressure has been applied, the hydraulic mechanism is capable of moving the plate to the first position at which the axial center of the groove and the axial center of the through-hole coincide. If hydraulic pressure has not been applied, the hydraulic mechanism is capable of moving the plate to the second position at which the axial center of the groove and the axial center of the through-hole do not coincide.

In accordance with the fourth aspect, the hydraulic mechanism is capable of supplying hydraulic pressure via the passageway penetrating the side wall of the outer lifter and formed at a portion thereof at which the plate is fitted into the outer lifter, and an annular groove formed in an outer peripheral portion of the side wall of the outer lifter. The outer peripheral portion includes the passageway. As a result, the plate can be slid easily from the outside via a small-diameter passageway (hydraulic line) regardless of the angular position of the outer lifter.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENT

A preferred embodiment of the present invention will now be described with reference to the drawings.

In general, at least one intake passageway and one exhaust passageway per cylinder communicate with an engine. An intake port and an exhaust port are formed on the intake and exhaust passageways, respectively, at the open end thereof located on the side of the cylinder. An intake valve is mounted in the suction port and an exhaust valve is mounted in the exhaust port. The constructions and operations of these valves are similar. In the embodiment set forth below, the construction and operation of the variable valve lift device according to the present invention will be described taking the intake valve as an example.

Figure 1:
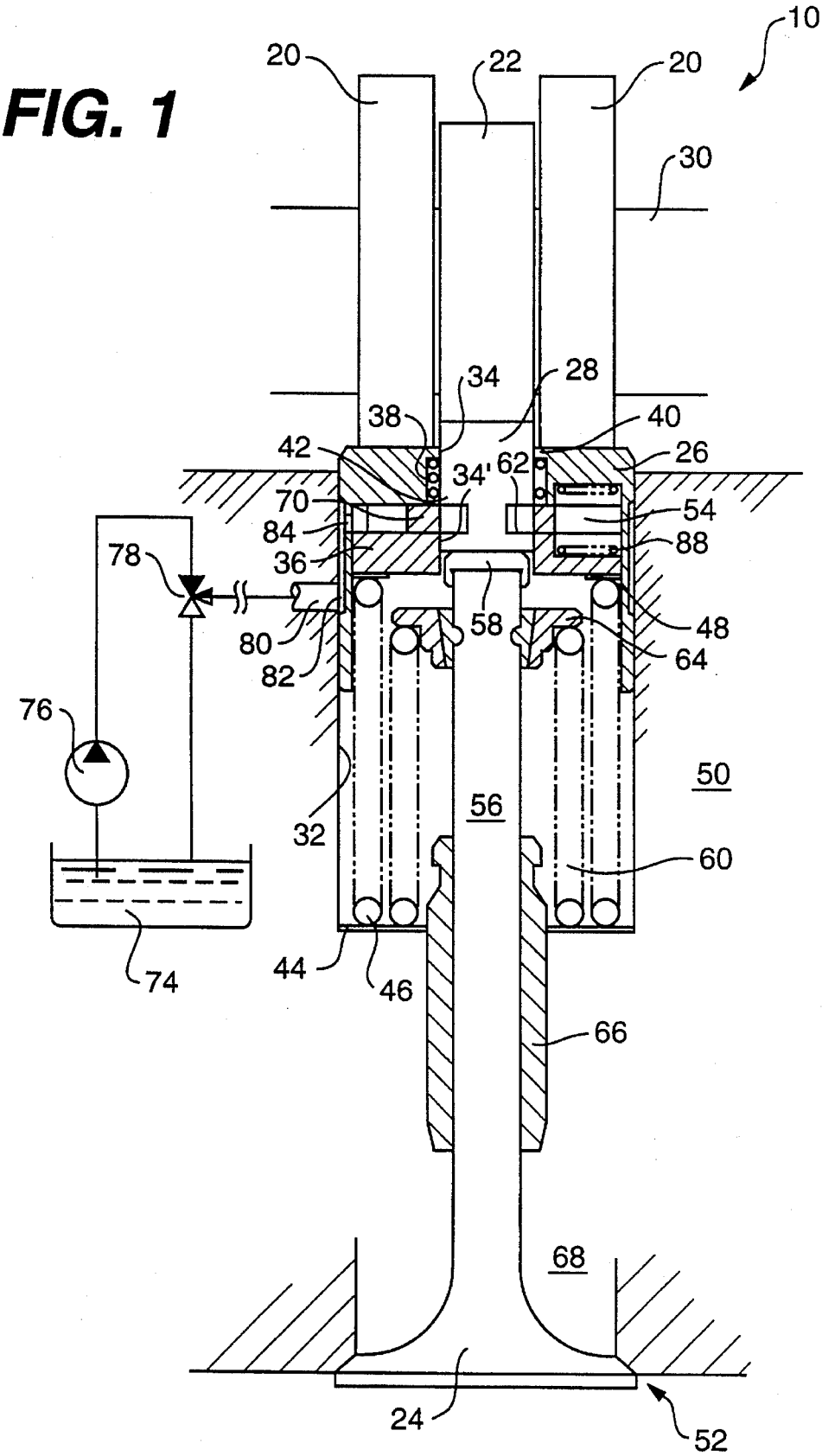
FIG. 1 is a sectional view illustrating a variable valve lift device according to an embodiment of the present invention.

FIG. 1 illustrates a variable valve lift device 10 according to the present invention applied to an engine. As shown in FIG. 1, two outer cams 20 for high lift and one inner cam 22 for low lift are illustrated in a state which prevails when the amounts of lift are zero. More specifically, the cams 20 and the cam 22 are in abutting contact with an outer lifter 26 and an inner lifter 28, respectively, at respective base circles of the cams. An intake valve 24 is closed in this state. The base circles of the cams 20 are designed to be larger than the base circle of the cam 22, and the upper end face of the inner lifter 28 is situated above the upper end face of the outer lifter 26 even when the amounts of lift of the cams 20 and cam 22 are zero. Further, the noses of the cams 20 are designed to be larger than the nose of the cam 22. The cams 20 and the cam 22 are fixedly secured to a cam shaft 30 to which the driving force of the engine is transmitted. The outer lifter 26 comprises a disk-shaped upper end wall and a cylindrically shaped side wall. The disk-shaped upper end wall is formed to have a through-hole 34 into which the intake valve 24 is fitted so as to be rotatable about and axially slidable along the axis thereof. The cylindrically shaped side wall of the outer lifter 26 is slidably fitted into a guide bore 32, which is formed in a cylinder head 50 along the axial direction of the intake valve 24, and is capable of being rotated about the axis of the intake valve 24. A spring 38 having a biasing force for urging the inner lifter 28 in the downward direction is disposed between retainers 40 and 42 formed in the upper portion of the through-hole 34 of outer lifter 26 and the intermediate portion of the inner lifter 28, respectively. The biasing force of the spring 38 is designed to be smaller than that of a valve spring 60. The spring 38 may be dispensed with if desired.

An inner body 36 is disposed within the outer lifter 26 and is free to move together with the outer lifter 26. A spring 46 is disposed between a spring seat 48, which is placed on the bottom of the inner body 36, and a retainer 44 provided on the cylinder head 50. The spring 46 biases the inner body 36 toward the outer lifter 26. The biasing force of the spring 38 is designed to be smaller than the biasing force of the spring 46. The inner body 36 is formed to have a through-hole 34' into which the inner lifter 28 is fitted so as to be rotatable about the axis of the intake valve 24 and slidable along the axial direction of the intake valve 24. A body hole 54 having a central axis which perpendicularly intersects the central axis of the intake valve 24 is formed between the outer lifter 26 and the inner body 36. The body hole 54 intersects the through-holes 34 and 34'.

The inner lifter 28 is freely slidably guided within the through-holes 34 and 34' so as to be in contact with the upper end portion of a stem 56 of suction valve 24 via an inner shim 58 at all times. The inner lifter 28 is formed to have an annular groove 62. The annular groove 62 is opened in the diametric direction of the inner lifter 28 and has opening width being capable of registering with the body hole 54, this width being substantially the same as the width of the body hole 54 is the axial direction thereof.

A retainer 64 is fastened to the upper end portion of the stem 56 via a cotter. The valve spring 60, which has a biasing force that biases the intake valve 24 in the closing direction (upward in FIG. 1), is loaded between the retainer 64 and the retainer 44 disposed on the cylinder head 50. A guide 66 fixedly secured within the bore of the cylinder head 50 is engaged with the outer periphery of the stem 56. Accordingly, the stem 56 of the intake valve 24 is capable of sliding up and down within the bore of the guide 66. The cylinder head 50 is formed to have an intake passageway 68 whose open end on the cylinder side is formed to include an port 52 equipped with a seat surface on which the intake valve 24 is capable of making and breaking contact.

A plate 70 having a thickness substantially the same as the opening width of the annular groove 62 of inner lifter 28, namely the width of the body hole 54 in the axial direction of the intake valve, is freely slidably guided within the body hole 54. The plate 70 is formed to have a through-hole 34" which extends in the axial direction of the intake valve 24. The plate 70 is formed in such a manner that the diameter of the through-hole 34" is approximately the same as the outer diameter of the inner lifter 28. The plate 70 is capable of moving between a first position (the position of the plate shown in FIG. 4) at which the axial center of the through-hole 34" and the axial center of the annular groove 62 formed in the inner lifter 28 coincide, and a second position (the position of the plate 70 depicted in FIG. 5) at which these axial centers do not coincide. At the first position illustrated in FIG. 4, the axial center of the through-hole 34" coincides with the axial center of the inner lifter 28 and, as a result, the inner lifter 28 is capable of moving together with the stem 56 inside the through-hole 34 of the outer lifter 26 and the through-hole 34' of the inner body 36. At the second position illustrated in FIG. 5, the axial center of the through-hole 34" does not coincide with the axial center of the inner lifter 28 and part of the plate 70 engages with the annular groove 62 of the inner lifter 28. As a result, the inner lifter 28 is incapable of moving together with the stem 56 inside the through-hole 34 of the outer lifter 26 and the through-hole 34' of the inner body 36.

A hydraulic chamber 72 is defined between the left end of the plate 70 and the outer lifter 26, and the hydraulic pressure is supplied by a hydraulic pump 76 from an oil pan 74 via an electromagnetic changeover valve 78, a hydraulic passageway 80 formed in the cylinder head 50, and an annular groove 82 and passageway 84 formed in the outer lifter 26. The electromagnetic changeover valve 78 is electrically connected to a control unit (not shown) to which the prevailing running conditions of the engine, such as engine rpm, engine load and the like are fed. Depending upon the engine running conditions, the control unit issues a command to the electromagnetic changeover valve 78. The changeover valve 78 is drived in response to the command so that the position of the plate 70 is switched to the first position or the second position. In other words, the plate 70 can be moved from the first position shown in FIG. 4 to the second position shown in FIG. 5 by hydraulic pressure acting upon the hydraulic chamber 72.

A spring chamber 86 is defined between the right end of the plate 70 and the outer lifter 26. A spring 88 is placed within the spring chamber 86 and urges the plate 70 against the hydraulic pressure, namely in a direction that reduces the volume of the hydraulic chamber 72. The biasing force of the spring 88 is designed to be smaller than the force produced by hydraulic pressure. When hydraulic pressure is not acting upon the hydraulic chamber 72, the plate 70 is maintained at the first position shown in FIG. 1 by the biasing force of the spring 88.

It should be noted that the surface of the upper portion of the annular groove 62 can be formed as a smooth guiding surface for the plate 70 by reducing the diameter of the outer circumference of the inner lifter 28 which is located below the bottom of the annular groove 62 formed in the inner lifter 28 as well as the inner diameter of the through-hole 34' of inner body 36, and further by enlarging the outer diameter of the retainer 42.

The operation of the variable valve lift device according to this embodiment constructed as set forth above will now be described.

Figure 4:
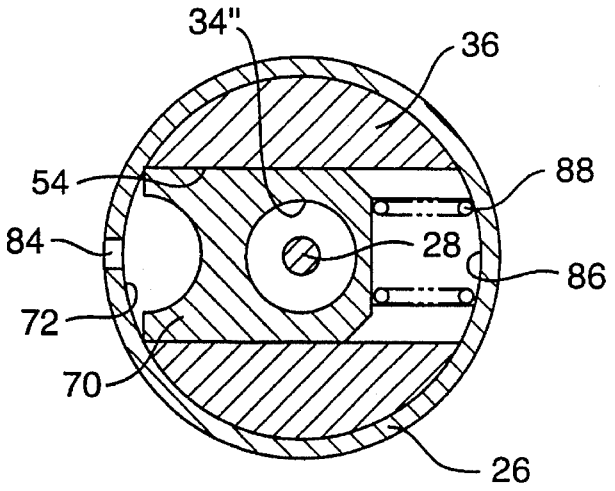
FIG. 4 is a sectional view illustrating a state in which the axial center of a through-hole in a plate and the axial center of an annular groove in an inner lifter are in coincidence.
Figure 5:
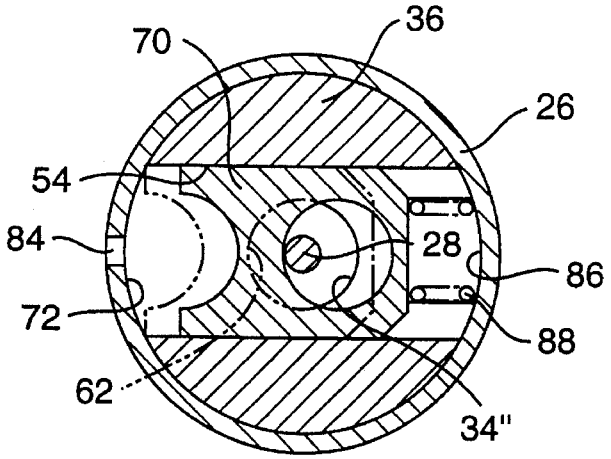
FIG. 5 is a sectional view illustrating a state in which the axial center of a through-hole in a plate and the axial center of an annular groove in an inner lifter are not in coincidence.

First, a case will be described in which the engine is running at low rpm or under a low load, i.e., in which the intake valve 24 is opened and closed under conditions of low lift. When the control unit (not shown) decides that changeover to the low-lift state is necessary, the control unit changes over the electromagnetic changeover valve 78 in such a manner that the hydraulic pressure within the hydraulic chamber 72 is discharged into the oil pan 74 via the hydraulic passageway 80, the groove 82 and the passageway 84. As a result, the plate 70 is moved from the second position (the position shown in FIG. 5) to the first position (the position shown in FIG. 4) owing to the biasing force of the spring 88, as shown in FIG. 4, and the plate 70 is stopped at the first position where the axial center of the through-hole 34" of plate 70 coincides with the axial center of the inner lifter 28. This enables relative movement between the inner lifter 28 and the plate 70, namely between the outer lifter 26 and the inner body 36.

Figure 2:
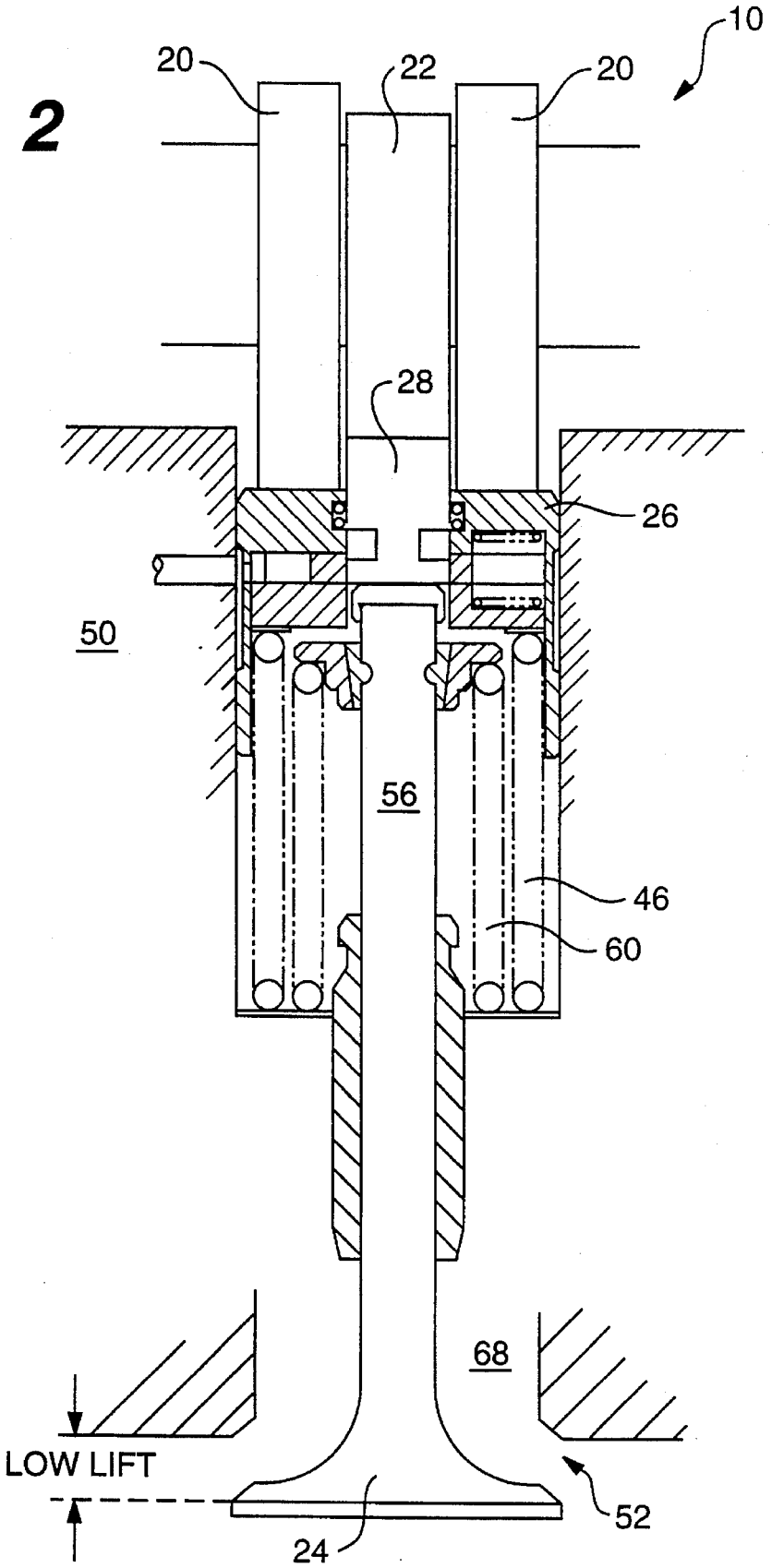
FIG. 2 is a sectional view illustrating the operation of the variable valve lift device of FIG. 1 at the time of low lift.

When the lift surfaces of the cams 20 and cam 22 shown in FIG. 1 begin to act upon the upper end faces of the outer lifter 26 and inner lifter 28 under these conditions, the amount of lift of the cam 22 is transmitted to the inner lifter 28, the stem 56 and the intake valve 24, this taking place against the biasing force of the valve spring 60. Meanwhile, the amount of lift of the cams 20 compresses the spring 38 to the maximum degree and compresses the spring 46 so that the outer lifter 26 is urged downward while sliding on the outer periphery of the inner lifter 28. In other words, the working force of the cams 20 has no relation to movement of the suction valve 24. When the condition shown in FIG. 2 is attained, i.e., when the cams 20 and cam 22 are at maximum lift, a state is achieved in which the intake valve 24 is opened fully with the amount of lift by the cam 22 being low. As the amounts of lift by the cams 20 and cam 22 diminish, the inner lifter 28 and outer lifter 26 are each urged upward by the biasing forces of the valve spring 60 and spring 46, as a result of which the intake valve 24 is restored to the closed state, which is that shown in FIG. 1.

Since the base circle of the inner cam 22 is smaller than that of the prior art, the area of the region of engagement at the cam surfaces between the inner cam 22 and the inner lifter 28 also is small and there is little possibility that peripheral portions of the inner cam 22 and inner lifter 28 will come into contact.

When, in a case where the engine is running at high rpm or under a high load, i.e., where the intake valve 24 is opened and closed under conditions of high lift, the control unit (not shown) decides that changeover to the high-lift state is necessary, the control unit changes over the electromagnetic changeover valve 78 in such a manner that the hydraulic pump 76 supplies hydraulic pressure from the oil pan 74 to the hydraulic chamber 72 via the hydraulic passageway 80, the groove 82 and the passageway 84. As a result, the plate 70 is moved from the first position to the second position against the biasing force of the spring 88, part of the plate 70 is thrust into the annular groove 62 formed in the inner lifter 28 and the plate is stopped with this part of the plate being engaged with the deepest portion of the annular groove 62. By virtue of this operation, relative movement is not allowed between the inner lifter 28 and the plate 70, namely between the outer lifter 26 and the inner body 36.

Figure 3:
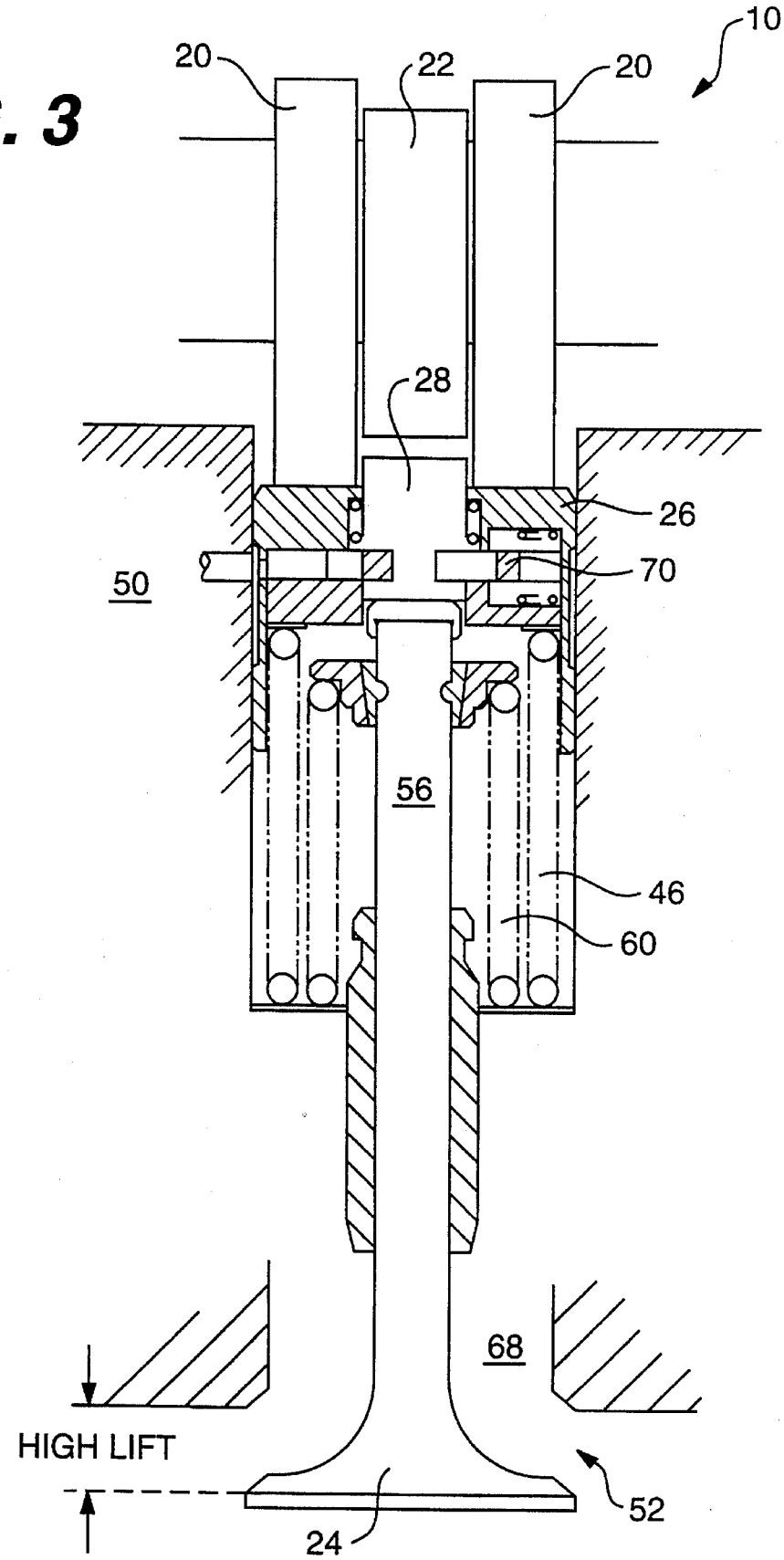
FIG. 3 is a sectional view illustrating the operation of the variable valve lift device of FIG. 1 at the time of high lift.

When the lift surfaces of the cams 20 and cam 22 shown in FIG. 1 begin to act upon the upper end faces of the outer lifter 26 and inner lifter 28 under these conditions, the amount of lift of the cams 20 is transmitted to the outer lifter 26, the plate 70, the inner lifter 28, the stem 56 and the intake valve 24, this taking place against the biasing force of the spring 46 and the valve spring 60. Meanwhile, since the nose of the cam 22 is designed to be smaller than the nose of the cams 20, the amount of lift of cam 22 is smaller than that of the cam 20 and the cam 22 gradually separates from the upper end face of the inner lifter 28 being urged downward by the cams 20. When the condition shown in FIG. 3 is attained, i.e., when the cams 20 and cam 22 are at maximum lift, a state in achieved in which the intake valve 24 is opened fully with the amount of lift by the cam 20 being high. As the amounts of lift by the cams 20 and cam 22 diminish, the inner lifter 28 and outer lifter 26 are each urged upward by the biasing forces of the valve spring 60 and spring 46, as a result of which the intake valve 24 is restored to the closed state, which is that shown in FIG. 1.

Figure 6:
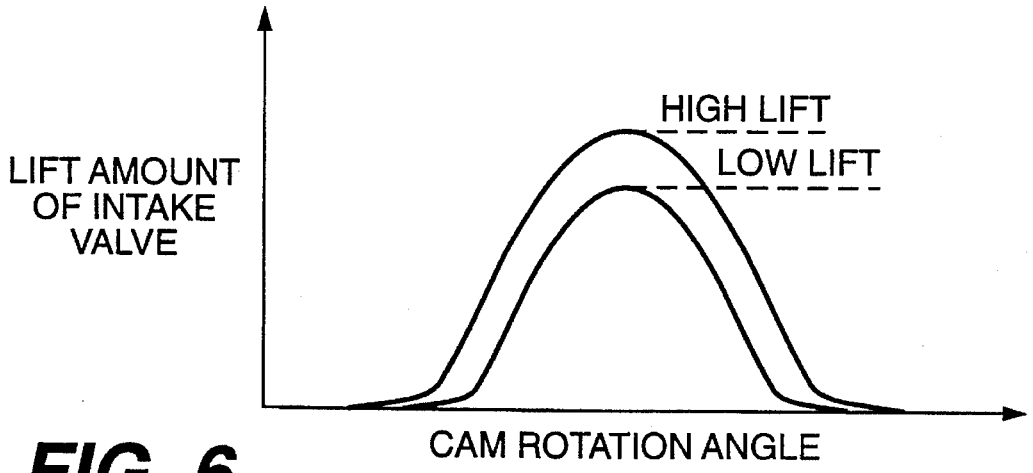
FIG. 6 is a diagram illustrating the relationship between the amount of lift of an intake valve and the angle of rotation of a cam (shaft) at the time of low lift and at the time of high lift.

Thus, the operating state of the variable valve lift device 10 can be changed over between a low-lift state and a high-lift state based upon a command from the control unit. FIG. 6 illustrates the relationship between the amount of lift of the intake valve 24 and the angle of rotation of the cams 20 and 22 at the time of low lift and at the time of high lift.

In the above mentioned embodiment, the present invention is applied to a variable valve lift device in which the plate 70 is biased toward the first position by the spring 88 and is moved toward the second position by the hydraulic pressure from the hydraulic pump 76. However, it is possible to apply the present invention to a variable valve lift device in which the plate 70 is biased toward the second position by the spring 88 and is moved toward the first position by the hydraulic pressure from the hydraulic pump 76.

Thus, in accordance with the present invention, the area of surface contact between the inner cam and the inner lifter can be reduced by reducing the diameter of the base circle of the inner cam. As a result, it is possible to prevent the inner cam from contacting the peripheral portion of the upper end faces of the rising inner lifter at the time of low rpm. This means that the cam and lifter will not sustain wear or deformation.

In accordance with the present invention, the plate is interposed between the outer lifter and the inner body internally of the outer lifter; cylindrical pin are not inserted. As a result, the outer lifter and the inner lifter need not be thickened in the axial directions thereof for the purpose of pin insertion. In addition, since a flat plate is used instead of cylindrical pins, thickness can be reduced by an equivalent amount. This makes it possible to reduce the overall bulk of the device.

In accordance with the present invention, the outer peripheral portion of the outer lifter need only be penetrated by a passageway of small diameter for supplying hydraulic pressure. Since it is unnecessary to provide a large hole for insertion of a pin, the after lifter will not sustain fatigue fracture.

In accordance with the present invention, the outer lifter and inner lifter are capable of relative rotation. This makes possible the relief of unnecessary operating force produced by the inner and outer cams, for which driving forces are different. In addition, machining and assembly are simplified because it is unnecessary to provide a rotation preventing mechanism.

More specifically, in accordance with the present invention, it is possible to provide a variable valve lift device so adapted as to suppress wear, deformation and fatigue fracture of the members constructing the device, thereby furnishing the device with durability and a long service life.

As many apparently widely different embodiments of the present invention can be made without departing from the spirit and scope thereof, it is to be understood that the invention is not limited to the specific embodiments thereof except as defined in the appended claims.

What is claimed is:

1. A variable valve lift device comprising:

an outer cam having a base circle and a nose;

an inner cam having a base circle and a nose smaller than the base circle and the nose of said outer cam;

at least one of an intake and exhaust valve opened and closed by being moved in the axial direction thereof, said valve being biased in the closing direction;

an outer lifter biased in a direction which brings it into contact with said outer cam, said outer lifter being provided in a cylinder head of an engine;

an inner lifter in abutting contact with an upper end face of said valve and having a groove in an outer periphery thereof;

a plate slidable in a direction which perpendicularly intersects the axis of said valve, said plate moving together with said outer lifter; and control means for moving said plate in the direction which perpendicularly intersects the axis of said valve;

said control means being capable of selecting a high-lift mode in which said plate is moved to a position at which it engages with said groove to thereby open/close said valve in a state of high lift, and a low-lift mode in which said plate is moved to a position at which it does not engage with said groove to thereby open/close said valve in a state of low lift.

2. A variable valve lift device comprising:

an outer cam having a base circle and a nose;

an inner cam having a base circle and a nose smaller than the base circle and the nose of said outer cam;

at least one of an intake and exhaust valve opened and closed by being moved in the axial direction thereof;

an inner lifter having a lower end face in abutting contact with an upper end face of said valve and having a groove in an outer periphery thereof;

an outer lifter having an upper end wall into which said inner lifter is fitted so as to be slidable in the axial direction of said valve, and a cylindrically shaped side wall slidably fitted into a guide bore provided in a cylinder head of an engine;

a plate slidable in a direction which perpendicularly intersects the axis of said valve, said plate being provided in said outer lifter and having a through-hole of a size substantially the same as the outer diameter of said inner lifter and a thickness for engaging with said groove, said inner lifter being slidable in said through-hole;

a first spring for biasing said valve in a direction which brings it into contact with a lifting face of said inner cam;

a second spring for biasing said outer lifter and said plate in a direction which bring them into contact with a lifting face of said outer cam;

a third spring for biasing said plate toward one of a first position at which an axial center of said groove and an axial center of said through-hole coincide and a second position at which an axial center of said groove and an axial center of said through-hole do not coincide;

a hydraulic mechanism for biasing said plate toward the other one of said first and second positions at which an axial center of said groove and an axial center of said through-hole do not coincide; and control means for controlling said hydraulic mechanism so that said plate is moved toward said first or second position.

3. The device according to claim 2, wherein said hydraulic mechanism supplies hydraulic pressure via a passageway penetrating the side wall of said outer lifter and formed at a portion thereof at which said plate is fitted into said outer lifter, and an annular groove formed in an outer peripheral portion of the side wall of said outer lifter, said outer peripheral portion including said passageway.

* * * * *